United States Patent [19]

McMonigle

[11] 4,402,808

[45] Sep. 6, 1983

[54] GASKET FOR SEALING JOINTS BETWEEN ELECTRODES AND ADJACENT CELL LINING AND FOR IMPROVING BATH CIRCULATION IN ELECTROLYSIS CELLS

[75] Inventor: Matthew J. McMonigle, New Kensington, Pa.

[73] Assignee: Aluminum Company of America, Pittsburgh, Pa.

[21] Appl. No.: 404,346

[22] Filed: Jul. 30, 1982

[51] Int. Cl.[3] ..... C25C 3/08; C25C 3/34; C25C 7/04

[52] U.S. Cl. ..... 204/247; 204/66; 204/67; 204/268

[58] Field of Search ..... 204/243 R-247, 204/66, 67, 268, 279

[56] References Cited

U.S. PATENT DOCUMENTS

| | | | |
|---|---|---|---|
| 1,545,383 | 7/1925 | Ashcroft . | |
| 3,764,509 | 10/1973 | Etzel et al. | 204/243 |
| 3,893,899 | 7/1975 | Dell et al. | 204/244 |
| 4,110,178 | 8/1978 | LaCamera et al. | 204/67 X |
| 4,140,594 | 2/1979 | Rogers, Jr. et al. | 204/247 X |
| 4,151,061 | 4/1979 | Ishikawa et al. | 204/247 |
| 4,290,874 | 9/1981 | McMonigle | 204/243 |

OTHER PUBLICATIONS

Bureau of Mines Report of Investigations No. 8166 "Recovery of Lead from Lead Chloride by Fused Salt Electrolysis".

*Primary Examiner*—Donald R. Valentine
*Attorney, Agent, or Firm*—Andrew Alexander

[57] ABSTRACT

An improved cell is disclosed for producing metal by electrolytic reduction of a metal halide in a molten bath comprising the metal halide dissolved in at least one molten halide of higher electrodecomposition potential than the metal halide. The cell includes an inner refractory lining and a plurality of electrodes which are located adjacent to and in abutment with the lining. The electrodes are disposed generally horizontally and arranged in at least one vertical stack. The electrodes in each stack are located beneath the upper level of the bath, and are arranged in a superimposed, spaced relationship defining inter-electrode spaces between each pair of adjacent electrodes. The cell also includes a vertical gas-lift passage associated with each stack of electrodes, which is in fluid communication with each inter-electrode space in the stack. The improved cell also includes inclined carbon felt gaskets located in at least some of the joints of abutment between the electrodes and the adjacent refractory lining for sealing of the joints in order to minimize the harmful effects of dislocation of the electrodes and for conducting halogen gas produced during operation of the cell from the inter-electrode spaces of a stack to the gas-lift passage associated with that stack.

8 Claims, 6 Drawing Figures

GASKET FOR SEALING JOINTS BETWEEN ELECTRODES AND ADJACENT CELL LINING AND FOR IMPROVING BATH CIRCULATION IN ELECTROLYSIS CELLS

BACKGROUND OF THE INVENTION

The present invention relates to electrolysis cells for the production of metal by the reduction of a metal halide in a molten bath comprising the metal halide dissolved in at least one molten halide of higher electrodecomposition potential than the metal halide. More particularly, this invention relates to a cell of this type which has an inner refractory lining and, located adjacent to and in abutment with the lining, a plurality of electrodes. These electrodes are disposed horizontally and arranged in at least one vertical stack in a superimposed, spaced relationship defining inter-electrode spaces between each pair of adjacent electrodes. During operation of a cell of this type, molten bath circulates through the inter-electrode spaces, and metal and halogen gas are produced therein. The present invention relates to an improvement in such cells for sealing of at least some of the joints of abutment between the electrodes and the adjacent refractory lining in order to avoid the deleterious consequences of physical shifts in the electrodes during operation of the cell and for enhancing the circulation of bath in the cell.

Electrolysis cells for the production of metal by the reduction of a metal halide in a molten halide bath have been known for many years. It is also known that bath circulation in such cells may be important, and that bath circulation patterns may be enhanced by directing the flow of halogen gas produced in the cell. A cell which is reportedly useful in connection with a process for the production of either zinc or lead by the reduction of the appropriate metal chloride, is described in U.S. Pat. No. 1,545,383 of Ashcroft. The Ashcroft cell includes an insulated refractory lining and a series of inclined graphite plates which function as bipolar electrodes. These electrodes are located adjacent to and in abutment with the refractory lining, and are arranged in a superimposed, spaced relationship defining inter-electrode spaces between each pair of adjacent electrodes. The cell is adapted to contain a molten bath of metallic chlorides, in which the electrodes are immersed. As electrolysis proceeds in this cell, metal and chlorine are produced in the inter-electrode spaces. Because of the inclination of the electrodes, the metal produced in the cell flows, under the influence of gravity, downwardly across the cathode surfaces of the electrodes and through holes in the electrodes to a metal-collecting zone in the bottom of the cell. At the same time, the chlorine produced in the cell flows, because of its buoyancy, upwardly across the inclined anode surfaces of the electrodes and through holes therein to a gas-collecting zone in the top of the cell. The anode and cathode surfaces of the electrodes of this cell may be corrugated to facilitate the flows of metal and chlorine in the cell. These flows reportedly induce circulation of the bath in the cell and thereby facilitate continuous electrolysis.

A bipolar electrolysis cell for the production of lead by the reduction of lead chloride in a molten halide bath is described in Bureau of Mines Report of Investigations No. 8166, entitled "Recovery of Lead From Lead Chloride by Fused-Salt Electrolysis". This cell includes an inner refractory lining and a plurality of graphite plates which function as bipolar electrodes. These electrodes are located adjacent to and in abutment with the refractory lining, and are arranged in a vertical stack in a superimposed, spaced relationship defining inter-electrode spaces between each pair of adjacent electrodes. The electrodes are inclined slightly from the horizontal and grooved on the anode and cathode surfaces to direct the flow of lead and chlorine produced during electrolysis to opposite sides of the cell. Gaps on both sides of the stack of electrodes allow lead to flow downwardly and chlorine to flow upwardly on opposite sides of the stack.

A bipolar electrolysis cell which is particularly adapted for the production of aluminum by the electrolytic reduction of aluminum chloride in a molten halide bath is described in U.S. Pat. No. 3,893,899 of Dell et al. This cell includes an anode, at least one intermediate bipolar electrode and a cathode in a superimposed, spaced relationship defining inter-electrode spaces therebetween. These electrodes, unlike the electrodes in the Ashcroft cell, are preferably disposed horizontally within a vertical stack. Along one side of the stack of electrodes is located a bath-supply passage, which is in fluid communication with each inter-electrode space within the stack. Along the opposite side of the stack is a gas-lift passage, which is also in fluid communication with each inter-electrode space. As electrolysis proceeds in this cell, chlorine is produced on the anode surfaces of the electrodes, and metal is produced on the cathode surfaces. The chlorine is conducted through the inter-electrode spaces toward and into the gas-lift passage. This flow of chlorine induces a flow of molten bath into and out of each inter-electrode space, upwardly in the gas-lift passage, across the stack of electrodes and downwardly through the bath-supply passage. The flow of bath entrains metal produced on each cathode surface and carries it through and out of each inter-electrode space. The metal which is entrained by the flow of bath is carried into the gas-lift passage, where (except for fine droplets uncoalesced) it descends under the influence of gravity, in a direction opposite to that of the rising chlorine and bath, to the bottom of the cell.

In operating an electrolysis cell which includes an inner refractory lining and a plurality of electrodes located adjacent to and in abutment with the lining, and in which bath circulation is assisted by directing the flow of halogen gas produced therein, it has been found that inefficiencies in the bath circulation may arise from leakage of halogen gas and bath through the joints of abutment between the electrodes and the adjacent refractory lining. It is also known that electrodes in electrolysis cells may be subject to physical shifting within the cell during the operation thereof, even though such electrodes are located adjacent to and in abutment with an inner refractory lining. This shifting may result from mechanical stresses caused by thermal expansion or chemical reaction, or from buoyancy effects due to the relatively close densities of certain types of electrodes, especially carbonaceous electrodes, and the molten electrolyte bath in the cell. This shifting of electrodes may damage the electrodes, and it may produce gaps in the joints between the electrodes and the adjacent refractory lining. The appearance of these gaps may lead to penetration therethrough of metal and to deviations from the desired flow of halogen gas produced by the electrolysis process. This could result in re-halogenation of the metal and, in the case of carbonaceous electrodes, in the combination of the metal with the carbon of the electrodes on the surfaces thereof. Thus, halides and carbides of the metal may build up a sludge-like formation on the electrode surfaces, which would interfere with the efficient operation of the cell by reducing the anode-cathode spacing. Continued accumulation of sludge on the electrode surfaces could produce electrical short circuits, thus further impairing electrolysis.

The problem of shifting electrode blocks in electrolytic cells is discussed in U.S. Pat. No. 3,764,509 of Etzel et al. This reference discloses a means for minimizing the effect of mechanical stresses on the carbonaceous cathode in an electrolysis cell used for the production of aluminum. According to this reference, buckling or bulging of such a cathode due to mechanical stresses encountered in the operation of the cell can be minimized by providing the cathode in the form of a set of carbonaceous blocks, each block possessing four lateral surfaces, at least an opposed pair of which are inclined at different angles to the vertical. Thus, the assembled cathode obtains, by virtue of the shapes of its component blocks, a mutual wedging of the blocks against upwardly acting forces.

Another solution to the problem of the shifting of electrodes during operation of an electrolysis cell is described in U.S. Pat. No. 4,290,874 of McMonigle et al. According to this reference, an electrolysis cell may be provided with carbon felt gaskets located in the joints of abutment between electrodes or electrode elements and the adjacent refractory lining, in order to minimize or eliminate physical shifting of the electrodes during operation of the cell. These gaskets are provided in the form of sized pieces of a fabric of matted carbon fibers, which may be placed in notches that have been cut in the abutting electrodes or electrode elements at the joints to be sealed. Although these gaskets seal the joints of abutment between electrodes and the adjacent refractory lining against leakage of halogen gas and bath therethrough, they do not otherwise assist in the establishment and maintenance of the desired bath circulation.

SUMMARY OF THE INVENTION

It is an object of the present invention to provide an improved electrolysis cell which includes an inner refractory lining and a plurality of electrodes located adjacent to and in abutment with the lining, and which is suitable for producing metal by the reduction of a metal halide in a molten halide bath. It is another object of this invention to provide such a cell which may be operated in such a way as to minimize the deleterious effects of dislocations of the electrodes due to mechanical stresses or buoyancy effects encountered during operation of the cell. It is another object of this invention to provide such a cell which may be operated with improved circulation of bath therein. In accordance with these and other objects, an improved cell is provided with inclined carbon felt gaskets located in at least some of the joints of abutment between the electrodes and the adjacent refractory lining for sealing of the joints in order to minimize the harmful effects of dislocation of the electrodes and for directing the flow of the halogen gas produced during operation of the cell and thereby improving the circulation of the bath in the cell.

In order to facilitate an understanding of the invention, its features are illustrated in the accompanying drawings and a detailed description thereof follows. It should be understood nevertheless that it is not intended that the invention be limited to the particular embodiment shown. Various changes and alterations are contemplated such as would ordinarily occur to one skilled in the art to which the invention relates.

DETAILED DESCRIPTION OF THE INVENTION

Figure 1:
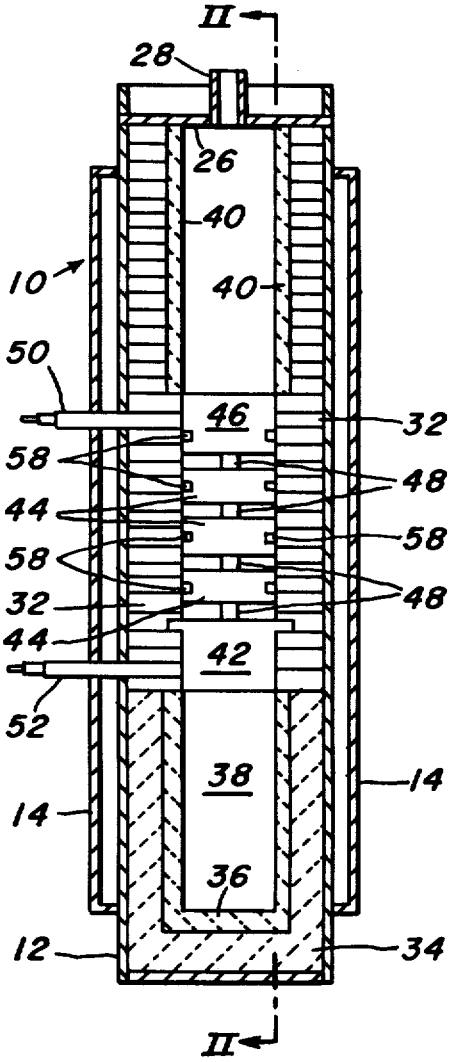
FIG. 1 is a sectional elevation of one embodiment of an electrolytic cell constructed in accordance with the principles of this invention.
Figure 3:
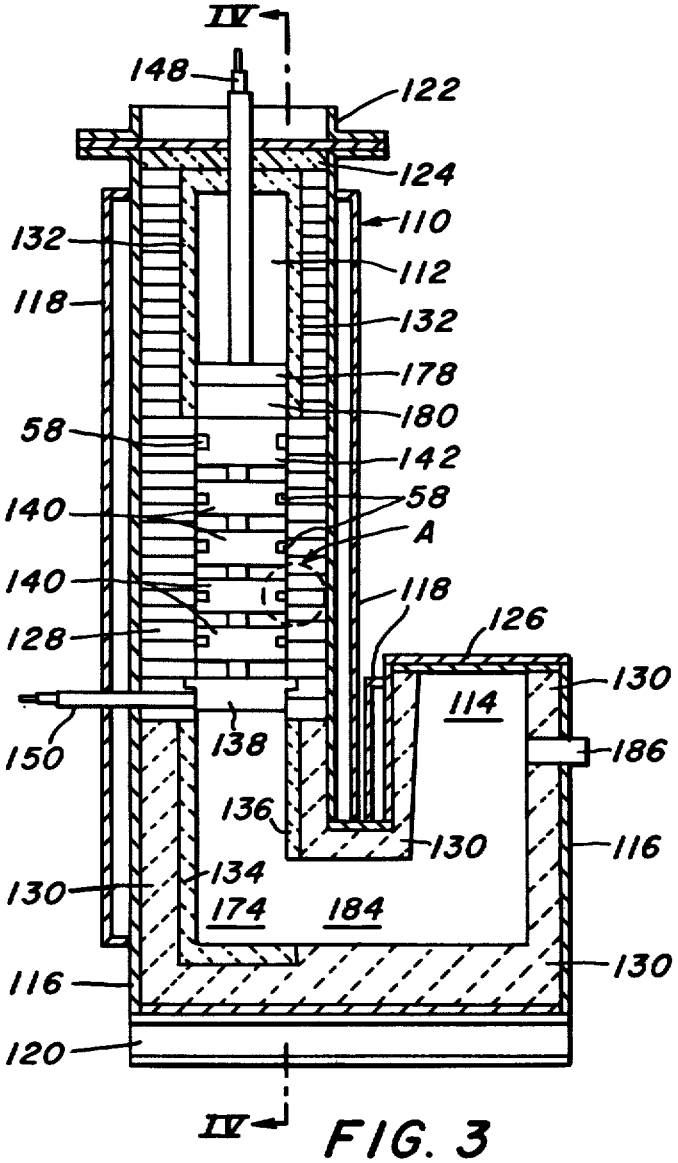
FIG. 3 is a sectional elevation of a second embodiment of an electrolytic cell constructed in accordance with the principles of this invention.
Figure 2:
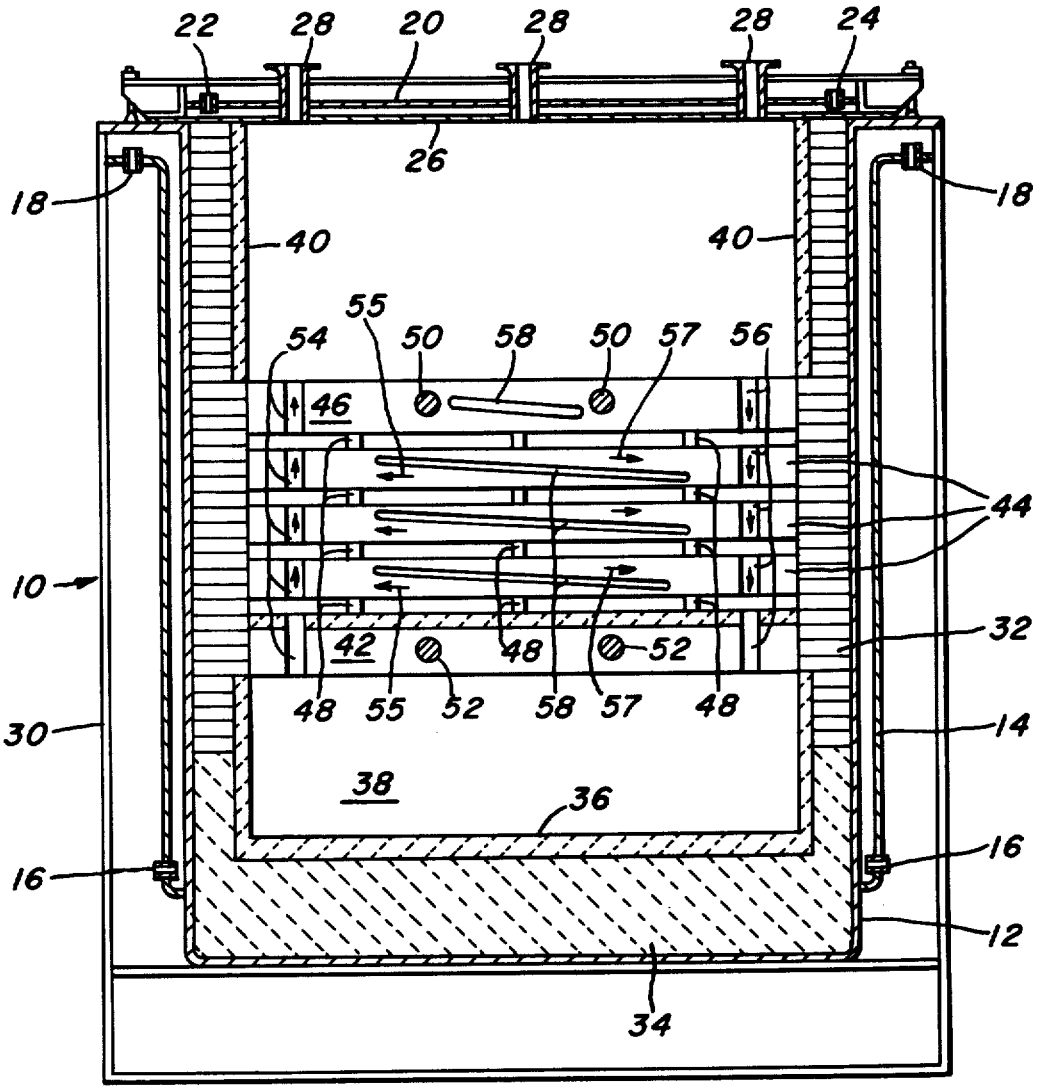
FIG. 2 is a sectional view of the cell of FIG. 1, taken along the line II—II.
Figure 4:
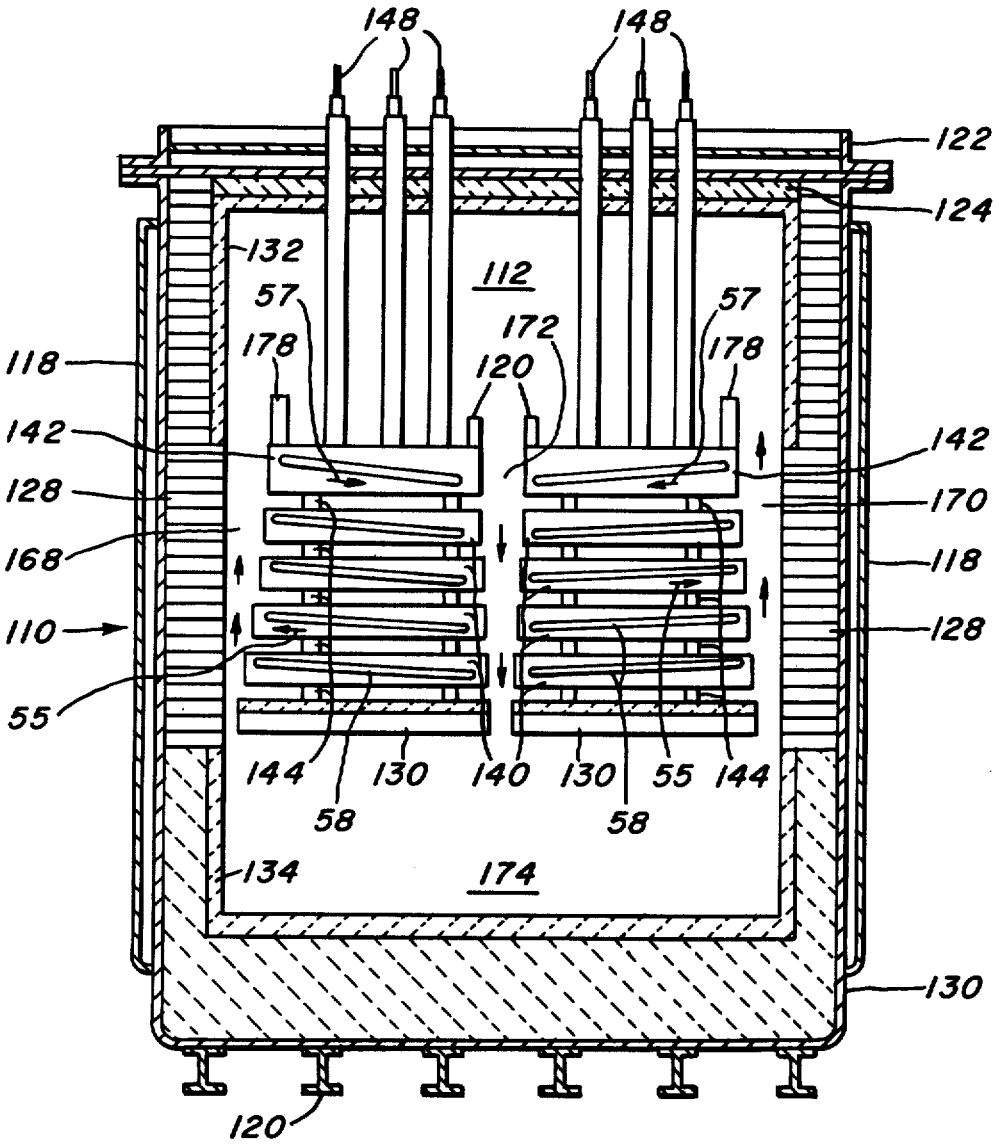
FIG. 4 is a sectional view of the cell of FIG. 3, taken along the line IV—IV.

Both the cell of FIGS. 1 and 2 and the cell of FIGS. 3 and 4 may be employed to produce metal by the electrolytic reduction of a metal halide in a molten bath comprising the metal halide dissolved in at least one molten halide of higher electrodecomposition potential than the metal halide. However, cell 10, the embodiment illustrated in FIGS. 1 and 2, is particularly appropriate for use in the production of aluminum by the electrolytic reduction of aluminum chloride ($AlCl_3$) in a molten bath containing a mixture of aluminum chloride, sodium chloride (NaCl) and lithium chloride (LiCl). Consequently, the discussion that follows describes cell 10 in terms that relate to the production of aluminum by such method.

Cell 10 includes outer shell 12, preferably of steel, bounded on its sides by cooling jacket 14. A coolant such as water flows through the jacket during operation of the cell to remove heat therefrom. The coolant enters jacket 14 at inlet ports 16, and is removed at exit ports 18. A similar cooling jacket 20 with inlet ports 22 (only one of which is shown) and exit ports 24 (only one of which is shown) is provided for cell cover 26. Located in the cover and extending therethrough are accessory ports 28. Such ports may be used for tapping metal from the cell, feeding metal chloride to the cell, venting chlorine gas from the cell, or for inspection, sampling or insertion of monitoring instruments. A structural containment 30 encloses shell 12 and cooling jacket 14, and provides support for the cell.

The cell is lined with an inner refractory brick lining 32. In the lower portion of the cell is located refractory lining 34. Located adjacent to and inside of lining 34 and a portion of lining 32 is carbonaceous lining 36, which is preferably made of graphite. Lining 36, which is fitted into machined recesses in linings 32 and 34, provides the boundary for sump 38, where metal produced in the cell is collected. Inner sidewall lining elements 40, preferably made of graphite, are fitted into machined recesses in brick lining 32 in the upper portion of the cell.

Within the cell cavity are a plurality of electrodes which are located adjacent to and in abutment with inner refractory lining 32. The electrodes are disposed horizontally and arranged in a vertical stack. In the embodiment illustrated in FIGS. 1 and 2, the stack includes cathode 42, three intermediate bipolar electrodes 44 and anode 46. The cathode has an upper lip which is fitted into machined recesses in brick lining 32. The remaining electrodes are stacked each above the ones below, with their sides abutting brick lining 32, in a spaced relationship established by interposed refractory spacers 48. These spacers are sized to closely space the electrodes so as to define inter-electrode spaces between each pair of adjacent electrodes. Preferably, the electrodes are spaced with their adjacent surfaces separated by ¾ inch or less. In the embodiment of FIGS. 1 and 2, four inter-electrode spaces are provided between opposed electrodes, one between the cathode and the lowest of the bipolar electrodes, two between successive pairs of intermediate bipolar electrodes and one between the highest of the bipolar electrodes and the anode. Each inter-electrode space is bounded on the top by a lower face of one electrode (which face functions as an anode) and on the bottom by an upper face of another electrode (which face functions as a cathode).

The anode 46 is connected to at least one anode terminal 50 (in the embodiment shown, there are two) which serves as a positive current lead. Similarly, the cathode 42 is connected to at least one cathode terminal 52 which serves as a negative current lead.

The anode terminals and the cathode terminals extend through and are suitably insulated from the electrically conductive portions of brick lining 32 and outer shell 12. When an appropriate voltage is imposed between anode 46 and cathode 42, a bipolar character is imparted to intermediate electrodes 44.

Cell 10 may be operated at a suitable temperature to produce metal by electrolytic reduction of a halide of the metal in a molten bath comprising the metal halide dissolved in at least one molten halide of higher electrodecomposition potential than the metal halide. When this call is operated to produce aluminum, therefore, the preferred operating temperature is within the range of 650°-800° C. and the preferred bath composition is comprised of aluminum chloride dissolved in one or more halides of higher electrodecomposition potential than aluminum chloride. These halides are preferably alkali metal chlorides, although other alkali metal halides and alkaline earth halides may be used. A presently preferred bath composition includes an alkali metal chloride base composition made up of about 50-75% by weight sodium chloride and 20-50% by weight lithium chloride. Aluminum chloride is dissolved in such base composition to provide a bath from which aluminum may be produced by electrolysis, and an aluminum chloride content of about 1.5-10% by weight of the bath will generally be desirable.

When cell 10 is operated in the preferred manner to produce aluminum, electrolysis takes place in each interelectrode space to produce chlorine on the lower (anode) face of the electrode at the top of the inter-electrode space and aluminum on the upper (cathode) face of the electrode at the bottom of the inter-electrode space.

Cell 10 includes a vertical gas-lift passage associated with its stack of electrodes. As shown in FIG. 2, the gas-lift passage, located on the left side of the stack of electrodes, is defined by passages 54 in cathode 42, in bipolar electrodes 44 and in anode 46. The gas-lift passage is in fluid communication with each inter-electrode space in the stack of electrodes.

Cell 10 also includes a vertical bath-supply passage associated with its stack of electrodes. The bath-supply passage is also in fluid communication with each inter-electrode space and is preferably located at the opposite side of the stack from the gas-lift passage. As shown in FIG. 2, the bath-supply passage, located on the right side of the stack of electrodes, is defined by passages 56 in cathode 42, in bipolar electrodes 44 and in anode 46.

In accordance with the invention, gaskets 59, preferably made of carbon felt, as will be described in more detail below, and provided to seal the joints of abutment between the electrodes and the adjacent refractory lining defining the wall of the cell, are mounted in inclined grooves 58 in the sides of electrodes 42, 44 and 46. The inclination of grooves 58 with respect to the horizontal may vary from 0.5° to 12°. This inclination of grooves 58 directs the flow of chlorine gas upwardly toward gas-lift passage 54, as shown by arrows 55. In similar fashion, the inclination of grooves 58 and the gaskets mounted therein direct the flow of reduced metal from the cathodes toward passages 56, as shown by arrows 57.

A second embodiment of an electrolytic cell which has been constructed in accordance with the present invention is illustrated in FIGS. 3 and 4. This cell, which is particularly adapted for the production of lead by the electrolytic reduction of lead chloride in a molten halide bath, is described in detail in my copending patent application entitled "Collection on Cathode Surfaces of Metal Produced in Electrolysis Cell".

Cell 110, illustrated in FIGS. 3 and 4, is preferably operated to produce lead by the electrolytic reduction of lead chloride in a molten bath containing a mixture of lead chloride, potassium chloride and lithium chloride. As a matter of fact, a cell of the design illustrated in FIGS. 3 and 4 has been constructed and used to produce lead by such method. Consequently, the discussion that follows describes cell 110 in terms that relate to the production of lead by the method which has been used.

Cell 110 includes electrolysis section 112, where lead is produced, and forewell chamber 114, where the metal produced is collected. Both section 112 and chamber 114 are contained within outer shell 116, which is preferably of steel. Structural support for the outer shell is aided by coolant liquid containment members 118 and I-beam 120, also preferably of steel. Electrolysis section 112 is enclosed by electrolysis lid assembly 122, which includes layer 124 of thermal insulation. The forewell chamber is enclosed by forewell lid assembly 126.

The upper portion of the electrolysis section of the cell is lined with an inner refractory brick lining 128. The lower portion of electrolysis section 112 and forewell chamber 114 are lined with an inner refractory lining 130 which preferably has a low thermal conductivity and is resistant to attack by molten metal. Located adjacent to and inside of linings 128 and 130 are carbonaceous lining elements 132, 134 and 136. These carbonaceous elements are especially resistant to attack by molten metal or chlorine gas. Carbonaceous elements 132, 134 and 136, preferably of graphite, are fitted into machined recesses in brick lining 128 and refractory lining 130.

Within electrolysis section 112 are a plurality of electrodes which are disposed horizontally and, in the embodiment illustrated, are arranged in two vertical stacks. Each stack includes a cathode 138, at least one intermediate bipolar electrode 140 (in the embodiment shown, there are four) and an anode 142. The cathode has an upper lip which is fitted into machined recesses in brick lining 128. The remaining electrodes are stacked each above the ones below, with their sides abutting brick lining 128, in a spaced relationship established by interposed refractory spacers 144. These spacers are sized to closely space the electrodes so as to define inter-electrode spaces between each pair of adjacent electrodes. Preferably, the electrodes are spaced with their adjacent surfaces separated by ¾ inch or less. In the illustrated embodiment, five inter-electrode spaces are provided between adjacent electrodes in each stack, one between the cathode and the lowest of the bipolar electrodes, three between successive pairs of intermediate bipolar electrodes and one between the highest of the bipolar electrodes and the anode. Each inter-electrode space is bounded on the top by a lower face of one electrode (which face functions as an anode) and on the bottom by an upper face of another electrode (which face functions as a cathode).

The anode 142 of each stack is connected to at least one anode terminal 148 (in the embodiment shown, there are three) which serves as a positive current lead. Similarly, each cathode 138 is connected to at least one cathode terminal 150 which serves as a negative current lead.

The anode terminals extend through and are suitably insulated from the electrically conductive portions of electrolysis lid assembly 122. Similarly, the cathode terminals extend through and are suitably insulated from the electrically conductive portions of brick lining 128, outer shell 116 and reinforcing member 118. When an appropriate voltage is imposed between the anode and the cathode in a stack, a bipolar character is imparted to the intermediate electrodes 140.

Cell 110 may be operated at a suitable temperature to produce metal by electrolytic reduction of a halide of the metal in a molten bath comprising the metal halide dissolved in at least one molten halide of higher electrodecomposition potential than the metal halide. When this cell is operated to produce lead, therefore, the preferred operating temperature is within the range of 400°-500° C. and the preferred bath composition is comprised of lead chloride dissolved in at least one molten halide of higher electrodecomposition potential than lead chloride. These halides are preferably alkali metal chlorides, although other alkali metal halides and alkaline earth halides may be used. Good results are obtained when the bath composition comprises a mixture of lead chloride, potassium chloride and lithium chloride. In a bath of this composition, it is desirable that the weight ratio of potassium chloride to lithium chloride be within the range of 1:1.4 to 2:1. A presently preferred bath composition comprises a mixture of 20–70% by weight lead chloride, 15–55% by weight potassium chloride and 10–40% by weight lithium chloride. An especially preferred composition contains about 40% by weight lead chloride, 35% by weight potassium chloride and 25% by weight lithium chloride.

When cell 110 is operated in the preferred manner to produce lead, electrolysis takes place in each inter-electrode space in a stack to produce chlorine on the lower (anode) face of the electrode at the top of the inter-electrode space and lead on the upper (cathode) face of the electrode at the bottom of the inter-electrode space.

In the preferred embodiment of cell 110, the upper face of each cathode and of each of the bipolar electrodes has at least one reservoir (not shown), bounded by a perimetric wall (not shown), for collecting metal produced in the cell. Each perimetric wall has at least one notch (not shown) therein cut to such a depth that a pool of the metal in the reservoir will be maintained at a level at the top of the perimetric wall and that metal produced during operation of the cell in excess of that required to fill the reservoir to said level will drain from the reservoir through the notches.

As shown in FIG. 4, cell 110 includes a vertical gas-lift passage associated with each stack of electrodes. The gas-lift passage is in fluid communication with each inter-electrode space in the stack. As shown in FIG. 4, cell 110 includes two gas-lift passages. Gas-lift passage 168 is associated with the left stack of electrodes, and gas-lift passage 170 is associated with the right stack of electrodes.

As shown in FIG. 4, cell 110 also includes a vertical bath-supply passage associated with each stack of electrodes. The bath-supply passage is also in fluid communication with each inter-electrode space in the stack and is preferably located at the opposite side of the stack from the gas-lift passage. Adjacent stacks of electrodes may share the same bath-supply passage. Thus, as shown in FIG. 4, both stacks of electrodes are associated with common bath-supply passage 172.

Below each stack of electrodes and in fluid communication with the bath-supply passage associated therewith is a metal-receiving chamber such as chamber 174 of cell 110. In the preferred embodiment of cell 110, the reservoirs and the notches in the perimetric walls of the reservoirs of each electrode in a stack are located so that metal produced during operation of the cell in excess of that required to fill the reservoirs to a level at the top of the perimetric wall will drain from the reservoirs through the notches into and downwardly through the bath-supply passage of the stack into the metal-receiving chamber. Consequently, metal from the reservoirs of the electrodes in the right stack drains through notches located on the left side of the electrodes into and downwardly through bath-supply passage 172 into metal-receiving chamber 174. At the same time, metal produced in the inter-electrode spaces of the left stack of electrodes drains through notches located on the right side of the electrodes into and downwardly through passage 172 into chamber 174.

The preferred embodiment of cell 110 includes a metal-collecting zone below each stack of electrodes. This zone is comprised of metal-receiving chamber 174, forewell chamber 114 and interconnecting lateral passage 184. The lateral passage provides fluid communication between and at the bottom of chambers 174 and 114, so that metal collected in the bottom of chamber 174 may flow into chamber 114. The metal-collecting zone is adapted so that metal which flows into the forewell chamber will fill said chamber to a height sufficient to prevent the entry of bath from electrolysis section 112 into the forewell chamber. A tapping port such as port 186 may be provided in the wall of the forewell chamber above the level of the lateral passage so that metal, uncontaminated with bath constituents, may be removed from the cell.

In accordance with the present invention, as previously discussed with respect to FIGS. 1 and 2, inclined carbon felt gaskets 59 are provided between at least some of the joints of abutment between the electrodes and the adjacent inner refractory lining. Thus, as illustrated in FIGS. 3 and 4, gaskets 59 are located in inclined slots 58 in the faces of the bipolar electrodes and the anodes that abut brick lining 128.

Slots or grooves 58 are inclined, similarly to the embodiment illustrated in FIGS. 1 and 2, at an angle which may be from 0.5° to 12° from the horizontal to permit the gas flow to proceed to gas-lift passages 168 and 170, as shown by arrows 55, and the reduced metal to flow toward passage 172, as shown by arrows 57.

Figure 5:
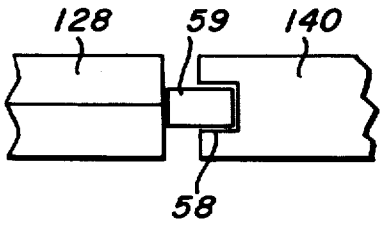
FIG. 5 is an enlarged view of the portion of the cell of FIGS. 3 and 4 indicated by the arrow A in FIG. 3.
Figure 6:
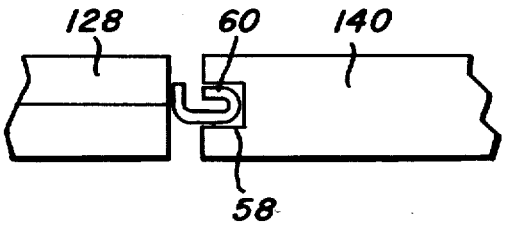
FIG. 6 is a sectional elevation which illustrates an alternative to the gasket configuration shown in FIGS. 4 and 5.

Gaskets 59 are provided in the form of sized pieces of a fabric of matted carbon fibers. Preferably, the gaskets are provided in a thickness of about ¾ inch (19 mm), although gaskets of greater or lesser dimension may also be used. Preferred results are obtained when the gaskets are placed in a U-shaped configuration, or the G-shaped configuration 60 (illustrated in FIG. 6) in an inclined notch that has been cut in one of the electrodes at the joint to be sealed. Good results may also be obtained when the gaskets are placed in the flat configuration 59 (illustrated in FIGS. 2, 4 and 5) in notch 58 that has been cut in one of the electrodes at the joint to be sealed. It has been found that the provision of such gaskets effectively seals the joints of abutment between the electrodes and the adjacent brick lining to minimize the effects of physical shifting of the electrodes during operation of the cell. Such shifting may result from mechanical stresses caused by thermal expansion or chemical reaction, or from buoyancy effects which may arise if the density of the electrodes is less than or approximately equal to that of the molten bath in the cell. It has been observed that because of the elasticity of its fibers, a gasket of this invention will expand to occupy space between an electrode and the adjacent brick lining upon a physical shift by the electrode. The gasket thus seals any gaps that result from shifting against penetration therethrough by bath constituents, halogen gas or metal produced.

The sealing effect achieved by the gaskets reduces the chance of metal accumulation in any gaps adjacent to the electrodes in the cell. Such accumulation could result in re-halogenation of the metal and, in the case of carbonaceous electrodes, in the combination of the metal with the carbon of the carbonaceous electrodes on the anodic surfaces thereof. The presence of the gaskets thus prevents the accumulation of halides and carbides of the metal on the anode surfaces and thereby helps to maintain proper anode-cathode spacing. Thus, efficient operation of the cell is maintained.

The provision of inclined gaskets in the joints of abutment between at least some of the electrodes and the adjacent refractory lining also directs the halogen gas produced during electrolysis along the inclined gaskets and out of the inter-electrode spaces of a stack of electrodes. Since the gaskets are inclined upwardly toward the gas-lift passage associated with the stack, the gas, because of its buoyancy, is directed by the gaskets into and upwardly through the gas-lift passage. The flow of gas out of the inter-electrode spaces of a stack into and upwardly through the gas-lift passage associated with the stack induces a flow of bath out of the inter-electrode spaces, into and upwardly through the gas-lift passage of the stack, across the top of the stack, into and downwardly through the bath-supply passage of the stack and into the inter-electrode spaces. Thus, in cell 10, flows of bath are induced out of the inter-electrode spaces of the stack, into and upwardly through the gas-lift passage defined by passages 54 through the electrodes on the left side of the stack, across the top of the stack from left to right (as viewed in FIG. 2), into and downwardly through the bath-supply passage defined by passages 56 through the electrodes on the right side of the stack and into the inter-electrode spaces. Similarly, in cell 110, flows of bath are induced out of the inter-electrode spaces of the left and right stacks, into and upwardly through passages 168 and 170 respectively, across the top of the stacks, into and downwardly through bath-supply passage 172 and into the inter-electrode spaces. In the preferred embodiment of cell 110, flow control baffles similar to those described in U.S. Pat. No. 4,110,178 may be used to assist in directing the flow of the bath from the gas-lift passage of a stack of electrodes across the top of the stack but beneath the upper level of the bath. As shown in FIG. 4, two baffles may be associated with each stack of electrodes. Thus, cell 110 includes baffles 178 located adjacent to the gas-lift passage of each stack and shorter baffles 180 located adjacent to the bath-supply passage of each stack. These baffles are adapted to direct the flow of bath as has been mentioned and to increase the velocity of the flow of bath in the inter-electrode spaces.

The provision of inclined gaskets in the joints of abutment between at least some of the electrodes and the adjacent refractory lining also directs the metal produced during electrolysis along the inclined gaskets and out of the inter-electrode spaces of a stack of electrodes. Since the gaskets are inclined downwardly toward the bath-supply passage associated with the stack, the metal, because of its density, is directed by the gaskets into and downwardly through the bath-supply passage.

The preferred embodiment of the cell also includes at least one inclined gas-channel (not shown) located in the lower face of each anode and in the lower face of each bipolar electrode for conducting chlorine gas produced during operation of the cell from the inter-electrode spaces of a stack to the gas-lift passage associated with that stack. These gas-channels should be provided with increasing depth in the direction toward the gas-lift passage.

The provision of inclined gaskets, in accordance with this invention, in at least some of the joints of abutment between electrodes and the adjacent refractory lining also reduces the dimensional accuracy required in the production of the electrodes. The electrodes may be sized to fit somewhat loosely into place, since expansion of the gaskets during cell operation will insure a proper fit of the electrodes.

It should be understood that this description of the preferred embodiment of the invention is susceptible to various modifications, changes and adaptations, and that the same are intended to be encompassed within the meaning and range of equivalents of the appended claims.

What is claimed is:

1. A cell for producing metal by electrolytic reduction of a metal halide in a molten bath comprising the metal halide dissolved in at least one molten halide of higher electrodecomposition potential than the metal halide comprising:

(a) an inner refractory lining;

(b) a plurality of electrodes, disposed horizontally and arranged in at least one vertical stack, the electrodes in each stack being:

(i) located adjacent to and in abutment with the inner refractory lining;

(ii) located beneath the upper level of the bath; and (iii) arranged in a superimposed, spaced relationship defining inter-electrode spaces between each pair of adjacent electrodes;

(c) a vertical gas-lift passage associated with each stack of electrodes which is in fluid communication with each inter-electrode space in the stack;

(d) a vertical bath-supply passage associated, with each stack of electrodes which is in fluid communication with each inter-electrode space in the stack; and (e) inclined carbon felt gaskets located in at least some of the joints of abutment between the electrodes and the adjacent inner refractory lining for sealing of said joints in order to minimize the harmful effects of dislocation of the electrodes and for conducting halogen gas produced during operation of the cell from the inter-electrode spaces of a stack to the gas-lift passage associated with that stack;

whereby halogen gas produced during operation of the cell in the inter-electrode spaces of a stack is conducted along the carbon felt gaskets into and upwardly through the gas-lift passage of said stack and a flow of bath will be induced out of the inter-electrode spaces of the stack, into and upwardly through the gas-lift passage of the stack, across the top of the stack, into and downwardly through the bath-supply passage of the stack, and into the inter-electrode spaces of the stack.

2. The cell of claim 1, which includes at least one inclined gas-channel in the lower face of each electrode, except for the lowermost electrode in each stack, for conducting halogen gas produced during operation of the cell from the inter-electrode spaces of a stack to the gas-lift passage associated with that stack.

3. The cell of claim 1, including a baffle, located adjacent to the gas-lift passage of each stack, which extends vertically above the uppermost electrode of the stack and which is adapted to assist in directing the flow of the bath from the gas-lift passage across the top of the stack but beneath the upper level of the bath.

4. The cell of claim 1, wherein the metal is lead and the bath comprises a mixture of lead chloride, potassium chloride and lithium chloride.

5. The cell of claim 4, wherein the carbon felt gaskets are inclined at an angle within the range of 0.5° to 12°.

6. The cell of claim 1, wherein the metal is aluminum and the bath comprises a mixture of aluminum chloride, lithium chloride and sodium chloride.

7. The cell of claim 6, wherein the carbon felt gaskets are inclined at an angle within the range of 0.5° to 12°.

8. A cell for the electrolytic production of metal by reduction of a metal halide dissolved in a molten salt bath comprising:

(a) an inner refractory lining including a vertical portion forming the walls of said cell;

(b) a plurality of electrodes generally horizontally disposed in said cell in a vertical stack and having side portions generally abutting the vertical wall portions of said lining;

(c) at least one passageway associated with said electrodes for the passage of gas evolved during the electrolysis process metal; and (d) sealing means disposed in a groove in said electrodes adjacent said vertical wall portion of said lining to prevent the passage of gas or metal therebetween, said groove being disposed at an angle to the horizontal to slope upwardly toward said gas passageway and downwardly toward said metal passageway;

whereby gas evolved in said electrolysis will be directed toward said gas passageway and metal evolved in said electrolysis will be directed downwardly toward said metal passageway.

* * * * *